US007178577B2

(12) United States Patent
Liu

(10) Patent No.: US 7,178,577 B2
(45) Date of Patent: Feb. 20, 2007

(54) REELING UNIT FOR A BLIND

(76) Inventor: Tai-Ping Liu, No. 18, Alley, Lane 3, Kuo-Chi St., Lung-Ching Hsiang, Taichung Hsien (TW)

( * ) Notice: Subject to any disclaimer, the term of this patent is extended or adjusted under 35 U.S.C. 154(b) by 264 days.

(21) Appl. No.: 10/881,645

(22) Filed: Jun. 30, 2004

(65) Prior Publication Data

US 2006/0000562 A1 Jan. 5, 2006

(51) Int. Cl.
*E06B 9/30* (2006.01)
*E06B 9/00* (2006.01)

(52) U.S. Cl. ..... 160/170; 160/178.1

(58) Field of Classification Search ..... 160/170, 160/171, 173 R, 84.04, 84.05, 84.01, 170 R, 160/171 R, 177 R, 178.1 R
See application file for complete search history.

(56) References Cited

U.S. PATENT DOCUMENTS 4,623,012 A * 11/1986 Rude et al. ..... 160/243
5,139,072 A * 8/1992 Marocco ..... 160/176.1 R
5,908,062 A * 6/1999 Fun ..... 160/170
6,619,365 B1 * 9/2003 Wen et al. ..... 160/168.1 P
6,736,184 B2 * 5/2004 Eaton ..... 160/84.02
6,745,969 B1 * 6/2004 Gouda ..... 242/375
6,845,802 B1 * 1/2005 Anderson et al. ..... 160/115
6,918,424 B2 * 7/2005 Lin ..... 160/171
6,964,291 B2 * 11/2005 Judkins ..... 160/170
7,025,107 B2 * 4/2006 Ciuca ..... 160/170

* cited by examiner

*Primary Examiner*—Hugh B. Thompson, II
*Assistant Examiner*—Candace L. Bradford
(74) *Attorney, Agent, or Firm*—Alan D. Kamrath; Nikolai & Mersereau, P.A.

(57) ABSTRACT

A reeling unit for a blind has a base (30) and a roller (40). The base (30) has a bottom plate (31), two side brackets (34, 35), and a string hole (33) defined in the bottom plate (31). The roller (40) has two ends (44, 43) pivotally mounted on the two side brackets (34, 35) of the base (30) and has a tapered body (41) wound with a string (50). By sliding on the tapered body (41), the string (50) is automatically and orderly arranged on the roller (40) to avoid tangles and overlaps of the string (50). Additionally, because each reeling unit (20) individually collects a single string (50), even multiple reeling units (20) mounted on a window accessory will not interfere with each other so that tangling problem of the string (50) between elements of the window accessory is avoided.

9 Claims, 5 Drawing Sheets

REELING UNIT FOR A BLIND

BACKGROUND OF THE INVENTION

1. Field of the Invention

The present invention relates to a reeling unit for a blind and, more particularly, a reeling unit that collects a string in order when the string is reeled on the reeling unit.

2. Description of Related Art

Conventionally, a winding device mounted on a venetian blind or similar comprises a headrail with two ends, a worm gear attached to one end of the headrail, a roller attached to the other end of the head rail, and a lift cord storable in a coiled manner around the worm gear. At least one connecting string is extended between the worm gear and the roller, and suspends a shade cloth at two ends so that the venetian blind moves at the two ends synchronically and evenly.

However, the at least one connecting string extended between the elements of the winding device easily becomes tangled, and this results in malfunction. Additionally, as the shade cloth is strung up only at the two ends, it can not be easily lifted especially when the shade cloth is wide and heavy. Adding more connecting strings to string up the shade cloth between the two ends is a solution for that problem, but providing more connecting strings causes more possibility of them tangling together.

The present invention has arisen to mitigate or obviate the drawbacks of the conventional winding device for a blind.

SUMMARY OF THE INVENTION

The main objective of the present invention is to provide a reeling unit for a blind; which collects a string in order without tangling or overlapping by the string itself.

Further benefits and advantages of the present invention will become apparent after a careful reading of the detailed description with appropriate reference to the accompanying drawings.

DETAILED DESCRIPTION OF THE PREFERRED EMBODIMENT

A reeling unit for a blind in accordance with the present invention comprises a base and a roller. The base has a bottom plate, two side brackets, and a string hole defined in the bottom plate. The roller has two ends pivotally mounted on the two side brackets of the base and a tapered body wound with a string. By sliding on the tapered body, the string is automatically and orderly arranged on the roller to avoid tangles of the string. Additionally, because each reeling unit individually collects a single string, even multiple reeling units mounted on a window accessory will not interfere with each other so that any tangling problem of the string between elements of the window accessory is avoided.

Figure 1:
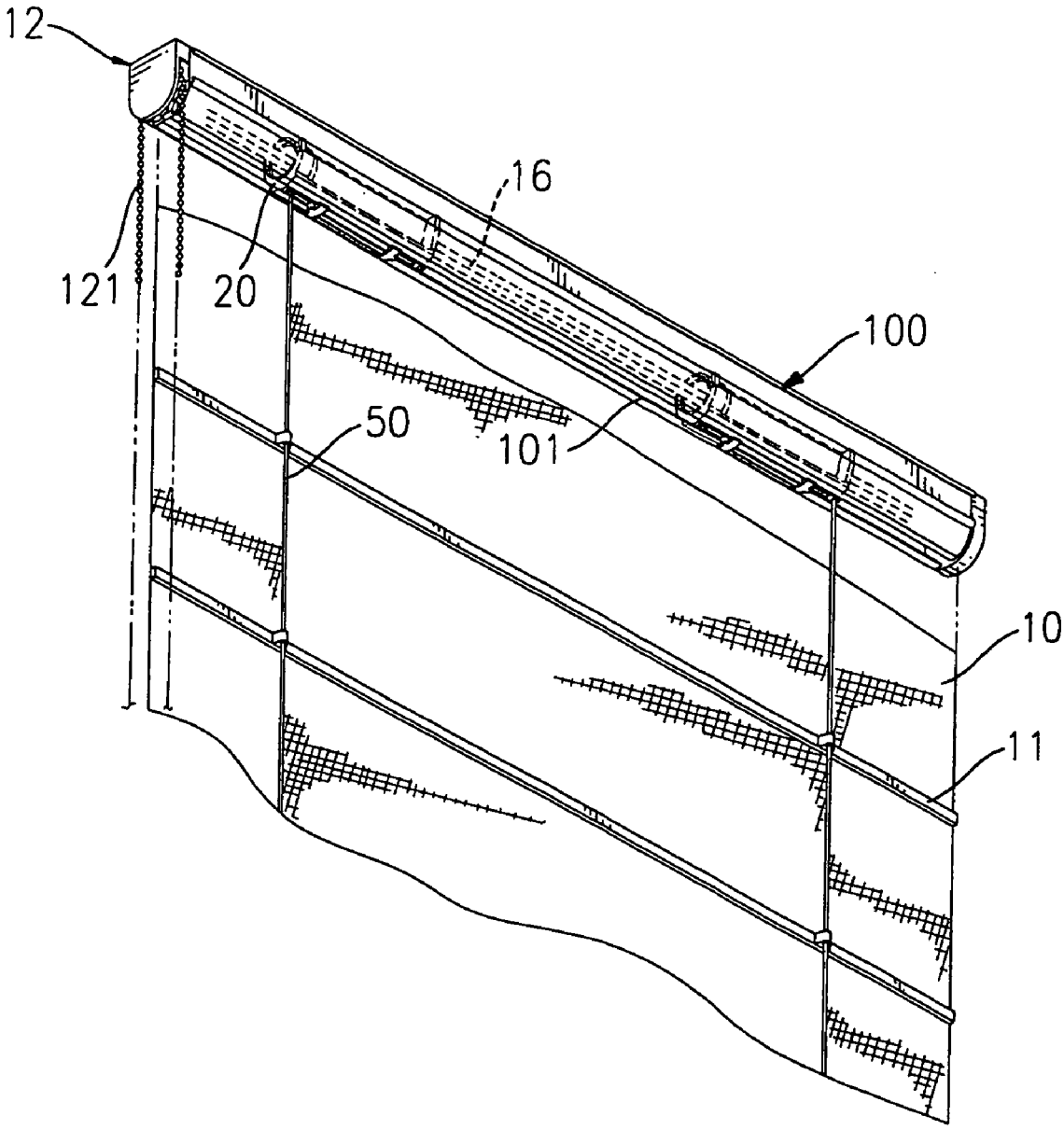
FIG. 1 is an operational perspective view of two reeling units in accordance with the present invention, wherein the two reeling units are mounted on a headrail of a window accessory.

With reference to FIG. 1, the reeling units (20) are selectively mounted on a window accessory in quantities according to the weight and the width of a shade cloth (10). The window accessory basically comprises a headrail (100) with two ends, a driving shaft (16) rotatably and longitudinally extending inside the headrail (100), and a cord-controlling device (12) mounted on one end of the headrail (100). The cord-controlling device (12) has a cord (121) hanging down and that can be pulled to drive the driving shaft (16). Two reeling units (20) are mounted on the driving shaft (16) inside the headrail (100) and each reeling unit (20) has a string (50) extending down to attach to the shade cloth (10). Additionally, multiple ribs (11) mounted on the shade cloth (10) are parallel with each other and penetrated by the strings (50) of the reeling units (20) to enable the shade cloth (10) to be lifted evenly.

Figure 2:
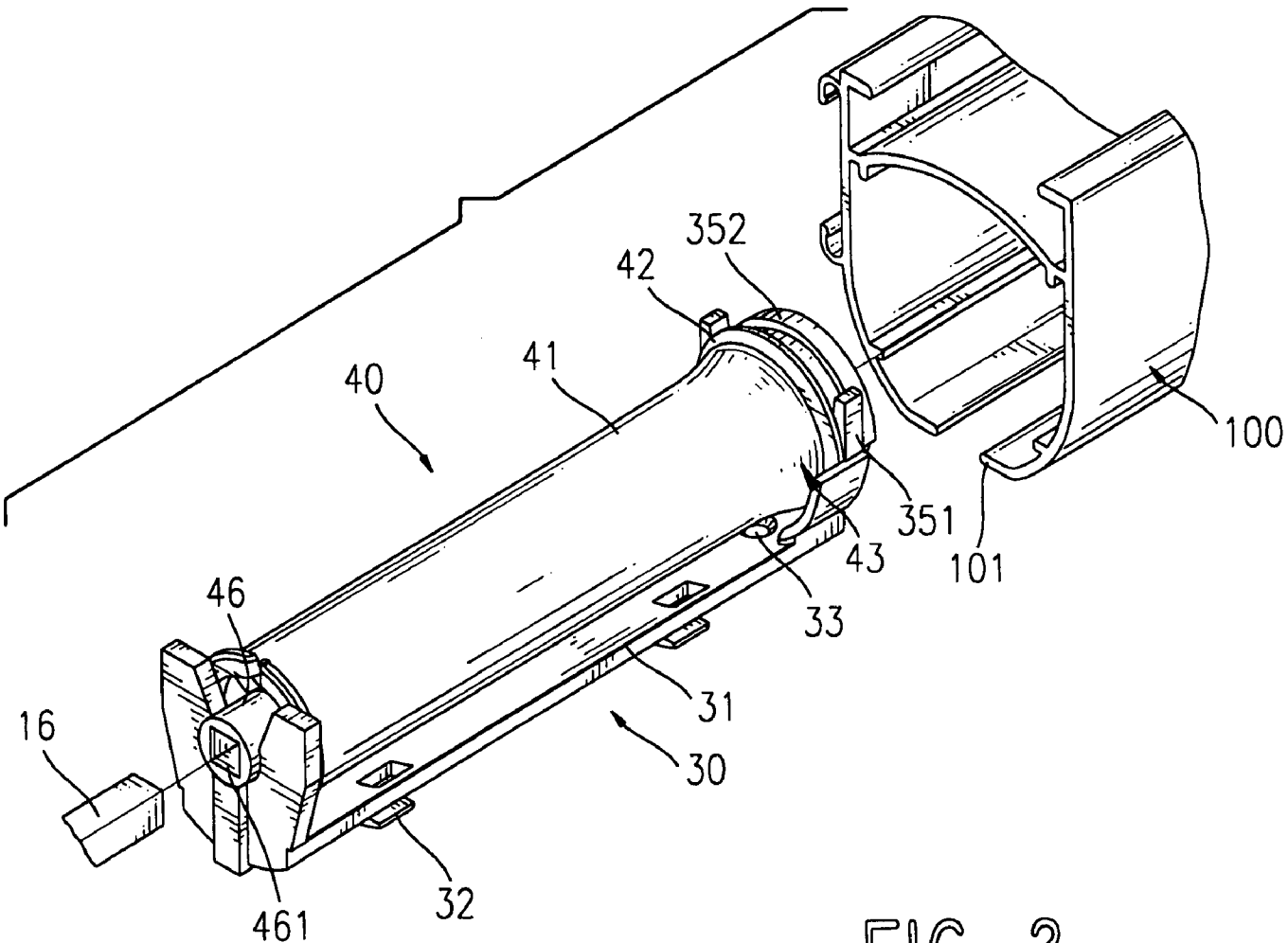
FIG. 2 is an enlarged exploded perspective view of the window accessory, wherein one reeling unit is detached from the headrail.
Figure 3:
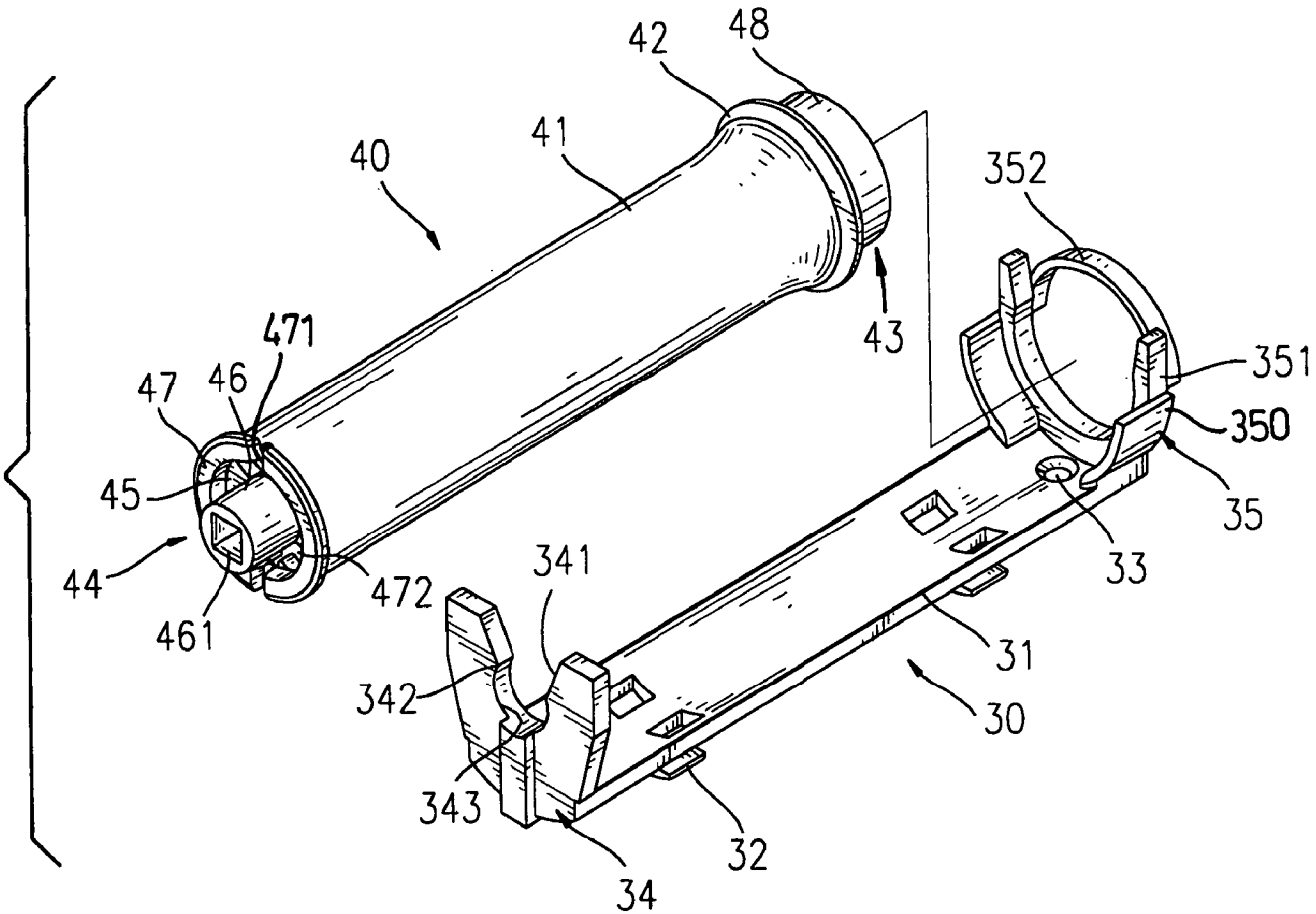
FIG. 3 is an enlarged exploded perspective view of the reeling unit in FIG. 2.
Figure 4:
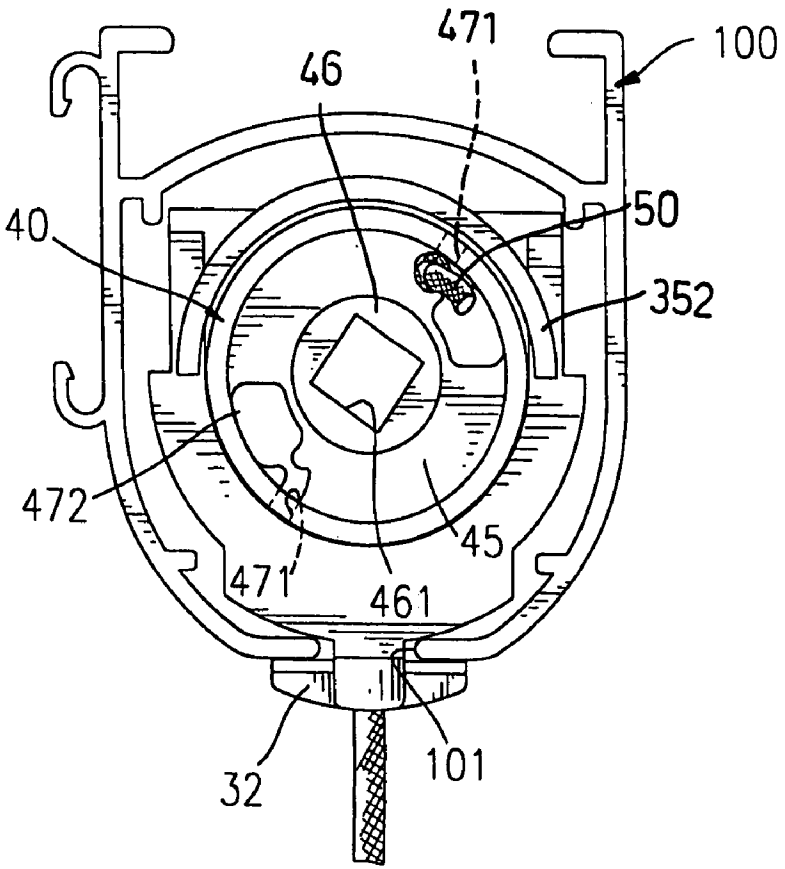
FIG. 4 is an assembled cross-sectional side plane view of reeling unit mounted inside the headrail.

With further reference to FIGS. 2 to 4, a preferred embodiment of the reeling unit (20) in accordance with the present invention comprises a base (30) and a roller (40) mounted on the base (30).

The base (30) is detachably received inside the headrail (100) and has a bottom plate (31) with two ends, a first bracket (34) attached at one end, and a second bracket (35) attached at the other end. The bottom plate (31) is a curved strip and has a top face, a bottom face, a string hole (33) and two pairs of hooks (32). The string hole (33) is defined in the bottom plate (31) near the second bracket (35), and the two pairs of the hooks (32) are formed on the bottom face of the bottom plate (31). Each hook of the pair of the hooks (32) has two hooks each having a distal point extending outward and oppositely to each other so that the pair of hooks (32) can slidably and respectively engage with two wings (101) of the headrail (100).

The first bracket (34) is a plate erectly attached to one end of the bottom plate (31) and has a top and a funnel-shaped cutout (341) defined in the top of the first bracket (34). Furthermore, the funnel-shaped cutout (341) has a bottom and an axis recess (343) defined in the bottom of the funnel-shaped cutout (341). The axis recess (343) is round and has a pass (342) communicating with the funnel-shaped cutout (341). The pass (342) has an opening width less than a diameter of the axis recess (343) so that an axis can be rotatably limited inside the axis recess (343).

The second bracket (35) is composed of two curved arms (350) attached on the top face of the bottom plate (31) and extended upward to form a U-shaped recess for placing the roller (40), wherein the string hole (33) is defined in the bottom plate (31) between the two curved arms (350). Each curved arm (350) has an inner face and a distal side far away from the first bracket (35). Furthermore, two stops (351) are respectively formed on the inner faces close to the distal side of the two curved arms (350). A top arc (352) has two ends respectively attached at two outer sides of the two stops (351) to cross over the U-shaped recess in side plane view.

The roller (40) is rotatably mounted on the base (30) and has an axle end (44), an abutting end (43) and a tapered body (41) extended between the axle end (44) and the abutting end (43).

The axle end (44) has a port with an edge and a bottom (45), a driven axle (46) with a polygonal hole (461), a slit (472), and optional annular flange (47). The driven axle (46) protrudes from the bottom (45) of the port and the polygonal hole (461) is longitudinally defined through the driven axle (46) to engage the driving shaft (16) on the window accessory, wherein the driving shaft (16) is a polygonal rod. Thereby, the roller (40) can be driven by rotating the driving shaft (16). The slit (472) is defined in the bottom (45) of the port around the driven axle (46) to allow a string (50) to be reeved therethrough. After penetrating the slit (472), a distal end of the string (50) is knotted to form a knot (51) to fasten the string (50) at the axle end (44) of the roller (40). The annular flange (47) is radially formed around the edge of the axle end (44) to abut the first side bracket (34) of the base (30) when the driven axle (46) is placed inside the axis recess (343). Additionally, the annular flange (47) further has a dent (471) defined on the annular flange (47) close to the slit (472) to clip the string (50) extending from the slit (472) and to guide the string (50) to wind on the roller (40) without contact with the first bracket (34).

The abutting end (43) has a distal opening with an edge, a drum (48) axially extending from the edge of the distal opening to correspondingly and rotatably engage with the U-shaped recess between the two curved arms (350). The abutting end (43) further has an annular stop (42) radially protruding from the edge of the distal opening to abut with the stops (351) on the second bracket (35) of the base (30).

Figure 5:
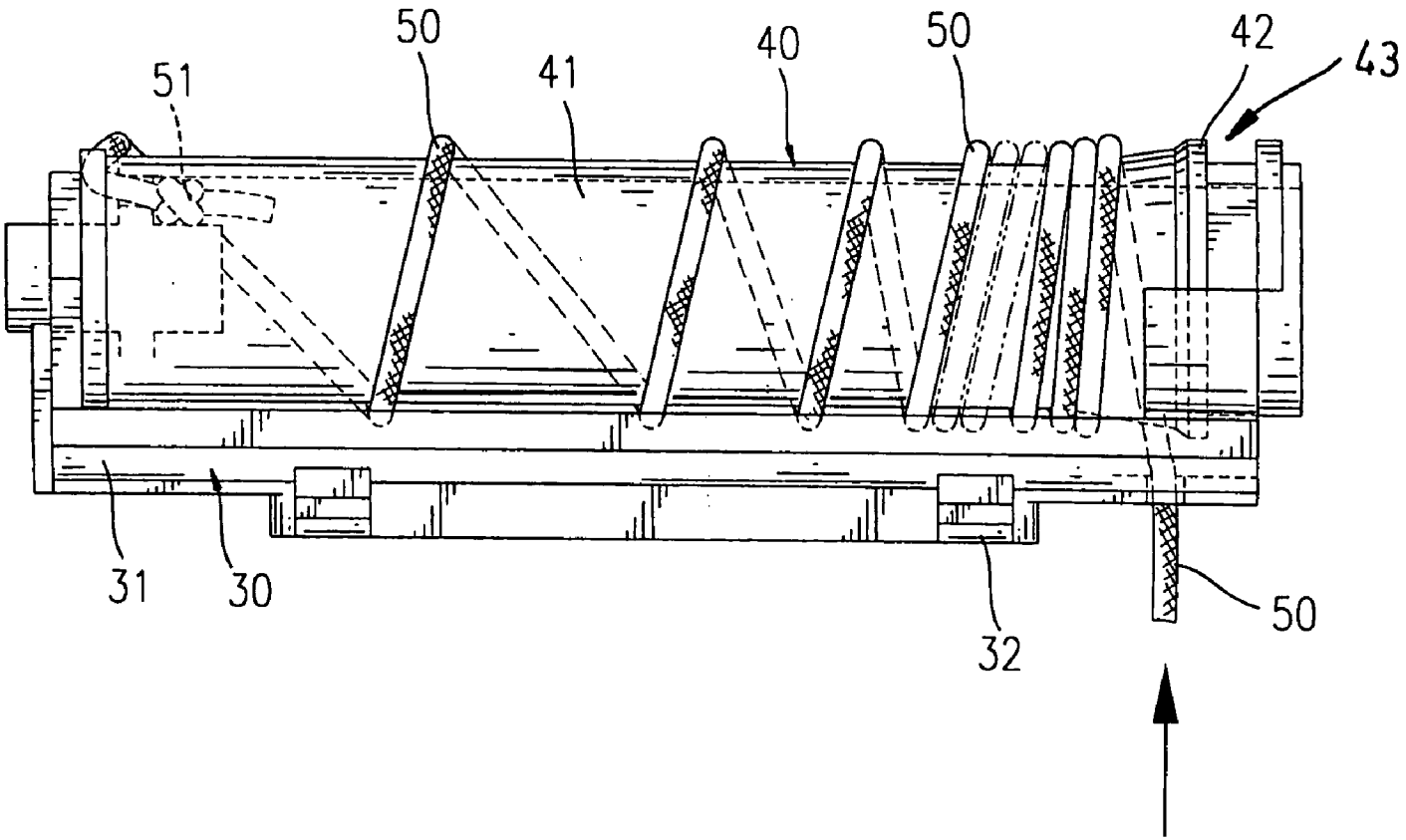
FIG. 5 is an operational side view of the reeling unit in FIG. 2.

The tapered body (41) is wound with the string 50 and has a smooth periphery, an enlarged end connected to the abutting end (43) and a narrow end connected to the axle end (44). With reference to FIG. 5, the enlarged end guides the string (50) to move toward to the narrow end. The smooth periphery exists all over the tapered body (41) to allow the string (50) to smoothly slide down from the enlarged portion to the first bracket (34) when the roller (40) rotates. Therefore, when the string (50) is wound up to form multiple loops orderly arranged on the roller (40) one by one, the multiple loops do not overlap or tangle with each other because a former loop moves away from the enlarged portion before a new loop is formed in sequence.

According to the above description, the reeling unit (20) of a blind in the present invention has the following advantages:

1. Each reeling unit (20) is simply attached on the window accessory by being penetrated by the driving shaft (16). Therefore, the reeling units (20) in desired quantities can be conveniently added onto the window accessory for lifting different types of shade cloths (10) having different widths or weights.

2. The multiple reeling units (20) are individual from the others in operation except the driving shaft (16) penetrates through all the reeling units (20) to drive them synchronically. Particularly, each string (50) respectively and individually hangs down from the corresponding reeling unit (20) to string up the shade cloth (10) and does not interact with other reeling units (20) or the window accessory. Therefore, the window accessory does not malfunction easily.

3. Elements and structures of the reeling unit (20) are simple whereby the manufacturing of the reeling unit (20) is accordingly straightforward. Naturally, the manufacturing cost is low.

Although the invention has been explained in relation to multiple preferred embodiments, many other possible modifications and variations can be made without departing from the spirit and scope of the invention as hereinafter claimed.

What is claimed is:

1. A reeling unit for a blind comprising:
a base having:
a bottom plate with two ends;
a first bracket attached at one end of the bottom plate; and
a second bracket attached at the other end of the bottom plate; and
a roller rotatably mounted on the base and having;
an axle end placed on the first bracket;
an abutting end placed on the second bracket; and
a tapered body extended between the axle end and the abutting end and having a smooth periphery all around the tapered body, wherein the first bracket of the base is a plate and has:
a funnel-shaped cutout with a bottom defined in the first bracket; and
an axis recess defined in the bottom of the funnel-shaped cutout and having a pass communicating with the funnel-shaped cutout, wherein the second bracket of the base has:
two curved arms attached on the top face of the bottom plate and extended upward to form a U-shaped recess;
two stops respectively formed on the two arms; and
a top arc having two ends respectively attached to the two stops over the U-shaped recess.

2. The reeling unit as claimed in claim 1, wherein the bottom plate is a strip curved longitudinally and has:
a top face;
a bottom face;
a string hole defined in the bottom plate near the second bracket; and
two pairs of the hooks formed on the bottom face of the bottom plate.

3. A reeling unit for a blind comprising:
a base having:
a bottom plate with two ends;
a first bracket attached at one end of the bottom plate; and
a second bracket attached at the other end of the bottom plate; and
a roller rotatably mounted on the base and having
an axle end placed on the first bracket;
an abutting end placed on the second bracket; and
a tapered body extended between the axle end and the abutting end and having a smooth periphery all around the tapered body, wherein the first bracket of the base is a plate and has:
a funnel-shaped cutout with a bottom defined in the first bracket; and
an axis recess defined in the bottom of the funnel-shaped cutout and having a pass communicating with the funnel-shaped cutout, wherein the axle end of the roller has:
a port with an edge and a bottom;
a driven axle axially extending from the bottom of the port to be accommodated inside the axle recess on the base and having a polygonal hole longitudinally defined through the driven axle;
a slit defined in the bottom of the port beside the driven axle;
an annular flange radially extending from the edge of the port; and
a dent defined on the annular flange close to the slit.

4. The reeling unit as claimed in claim 3, wherein the first bracket of the base is a plate and has:
a funnel-shaped cutout with a bottom defined in the first bracket; and
an axis recess defined in the bottom of the funnel-shaped cutout and having a pass communicating with the funnel-shaped cutout.

5. The reeling unit as claimed in claim 3, wherein the bottom plate is a strip curved longitudinally and has:

a top face;

a bottom face;

a string hole defined in the bottom plate near the second bracket; and two pairs of the hooks formed on the bottom face of the bottom plate.

6. A reeling unit for a blind comprising:

a base having:

a bottom plate with two ends;

a first bracket attached at one end of the bottom plate; and a second bracket attached at the other end of the bottom plate; and a roller rotatably mounted on the base and having an axle end placed on the first bracket;

an abutting end placed on the second bracket; and a tapered body extended between the axle end and the abutting end and having a smooth periphery all around the tapered body, wherein the second bracket of the base has:

two curved arms attached on the top face of the bottom plate and extended upward to form a U-shaped recess;

two stops respectively formed on the two arms; and a top arc having two ends respectively attached to the two stops over the U-shaped recess, wherein the abutting end of the roller has:

a distal opening with an edge;

a drum axially extending from the edge of the distal opening to correspondingly and rotatably engage with the U-shaped recess between the two curved arms; and an annular stop radially extending from the edge of the distal opening to abut with the stops on the second bracket of the base.

7. The reeling unit as claimed in claim 6, wherein the bottom plate is a strip curved longitudinally and has:

a top face;

a bottom face;

a string hole defined in the bottom plate near the second bracket; and two pairs of the hooks formed on the bottom face of the bottom plate.

8. The reeling unit as claimed in claim 7, wherein the first bracket of the base is a plate and has:

a funnel-shaped cutout with a bottom defined in the first bracket; and an axis recess defined in the bottom of the funnel-shaped cutout and having a pass communicating with the funnel-shaped cutout.

9. The reeling unit as claimed in claim 6, wherein the first bracket of the base is a plate and has:

a funnel-shaped cutout with a bottom defined in the first bracket; and an axis recess defined in the bottom of the funnel-shaped cutout and having a pass communicating with the funnel-shaped cutout.

* * * * *